US007070080B2

(12) United States Patent
Lin

(10) Patent No.: US 7,070,080 B2
(45) Date of Patent: Jul. 4, 2006

(54) TRIGGERING SWITCHING DEVICE OF A NAIL DRIVER

(76) Inventor: Chien-Chuan Lin, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/913,578

(22) Filed: Aug. 9, 2004

(65) Prior Publication Data

US 2006/0027621 A1 Feb. 9, 2006

(51) Int. Cl.
*B25C 1/04* (2006.01)

(52) U.S. Cl. ..... 227/8; 227/130

(58) Field of Classification Search ..... 227/8, 227/130

See application file for complete search history.

(56) References Cited

U.S. PATENT DOCUMENTS 5,551,621 A * 9/1996 Vallee ..... 227/8
5,791,545 A * 8/1998 Lin ..... 227/8
6,116,488 A * 9/2000 Lee ..... 227/8
6,213,372 B1 * 4/2001 Chen ..... 227/8
6,431,425 B1 * 8/2002 Moorman et al. ..... 227/8
6,659,324 B1 * 12/2003 Liu ..... 227/8
6,675,999 B1 * 1/2004 Mukoyama et al. ..... 227/8
6,860,416 B1 * 3/2005 Chen ..... 227/8
6,886,729 B1 * 5/2005 Lee ..... 227/8
6,929,165 B1 * 8/2005 Chen et al. ..... 227/8

* cited by examiner

*Primary Examiner*—Scott A. Smith

(57) ABSTRACT

A triggering switching device of a nail driver comprises a nail driver body; a trigger in the nail driver body; a rotatable buckle block pivotally installed at one end of the trigger; the buckle block having a buckle end protruded from the other portions of the buckle block; a trigger switch at a rear side of the trigger. When the buckle block is moved so that the buckle end is vertical to the trigger and the moving length of the trigger as the trigger is pressed is shorten, an operation of continuous beating a nail is formed; moreover when the buckle block is moved to be parallel to the trigger, the moving length of the trigger is lengthened so as to be in a state of sequential beating a nail.

5 Claims, 5 Drawing Sheets

TRIGGERING SWITCHING DEVICE OF A NAIL DRIVER

FIELD OF THE INVENTION

The present invention relates to nail drivers, and particular to a triggering switching device of a nail driver, wherein one end of a trigger of a nail driver is installed with a buckle block. The state of continuous beating nail and sequential beating nail can be selected by adjusting the position of the buckle block.

BACKGROUND OF THE INVENTION

Referring to FIGS. 1 to 4, the prior art triggering switching device of a nail driver is illustrated. In switching the triggering mode of the prior art triggering switching device, a press end 91 aside the trigger 90 is pressed so that a rotation end 92 protrudes from another side for moving the rotation end 92. An eccentric shaft 920 above the rotation end 92 moves a trigger sheet 92 to move upwards or downwards for determining a first trigger portion 930 or a second triggering portion 931 to trigger a nail beating switch (not shown) behind the trigger 90. The first triggering portion 930 is near the trigger switch and the second triggering portion 931 is farther from the trigger switch so as to control the continuous beating or sequential beating of the nail.

However, the prior art has the following disadvantages.

In the prior art triggering switching device, one hand is used to press the press end and another end is used to rotate the rotation end for switching between the sequential beating and the continuous beating. The operation is performed by two hands. The user must place the nail driver to a table or ground surface, otherwise it is difficult to perform the operation. However, the operation is not personal.

The structure of the prior art triggering switching device is very complicated and many small round cylinder elements are used, which is unbeneficial to the assembly work. Thereby, the elements are easy to lose so as to affect the manufacturing speed and cost. However, this is also a burden of the users.

SUMMARY OF THE INVENTION

Accordingly, the primary object of the present invention is to provide a triggering switching device of a nail driver. The device comprises a nail driver body; a trigger in the nail driver body; a rotatable buckle block pivotally installed at one end of the trigger; the buckle block having a buckle end protruded from the other portions of the buckle block; a trigger switch at a rear side of the trigger. When the buckle block is moved so that the buckle end is vertical to the trigger, the moving length of the trigger as the trigger is pressed is shorten, an operation of continuous beating is formed; moreover when the buckle block is moved to be parallel to the trigger, the moving length of the trigger is lengthened so as to be in a state of sequential beating of nails.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
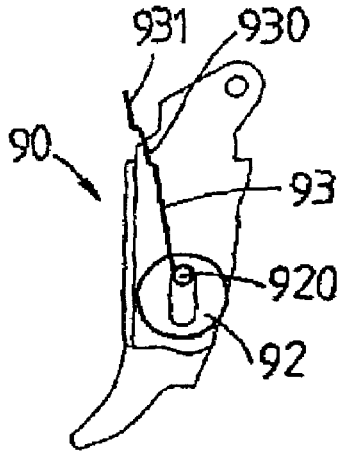
FIG. 1 (PRIOR ART)
FIG. 1 is a cross section view showing the sequential triggering of the triggering switching device of the prior art.
Figure 2:
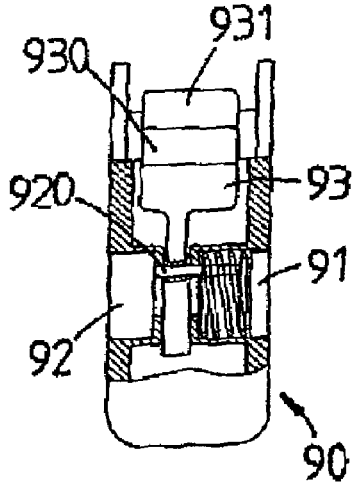
FIG. 2 (PRIOR ART)
FIG. 2 is another cross section view showing the sequential triggering of the triggering switching device of the prior art.
Figure 3:
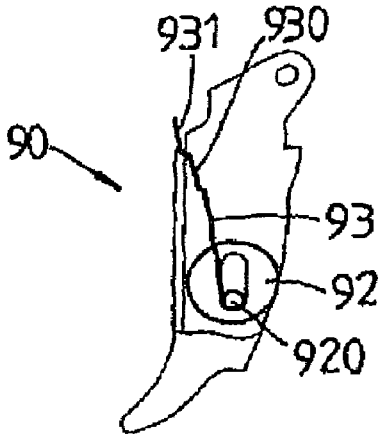
FIG. 3 (PRIOR ART)
FIG. 3 is a cross section view showing the continuous triggering of the triggering switching device of the prior art.
Figure 4:
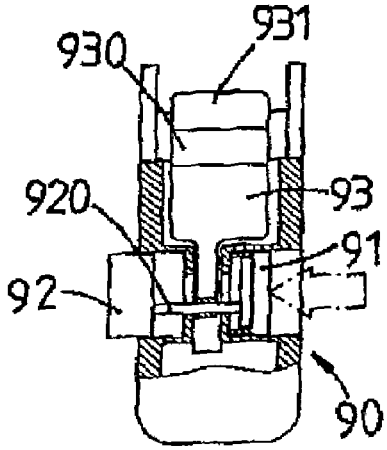
FIG. 4 (PRIOR ART)
FIG. 4 is another cross section view showing the continuous triggering of the triggering switching device of the prior art.
Figure 5:
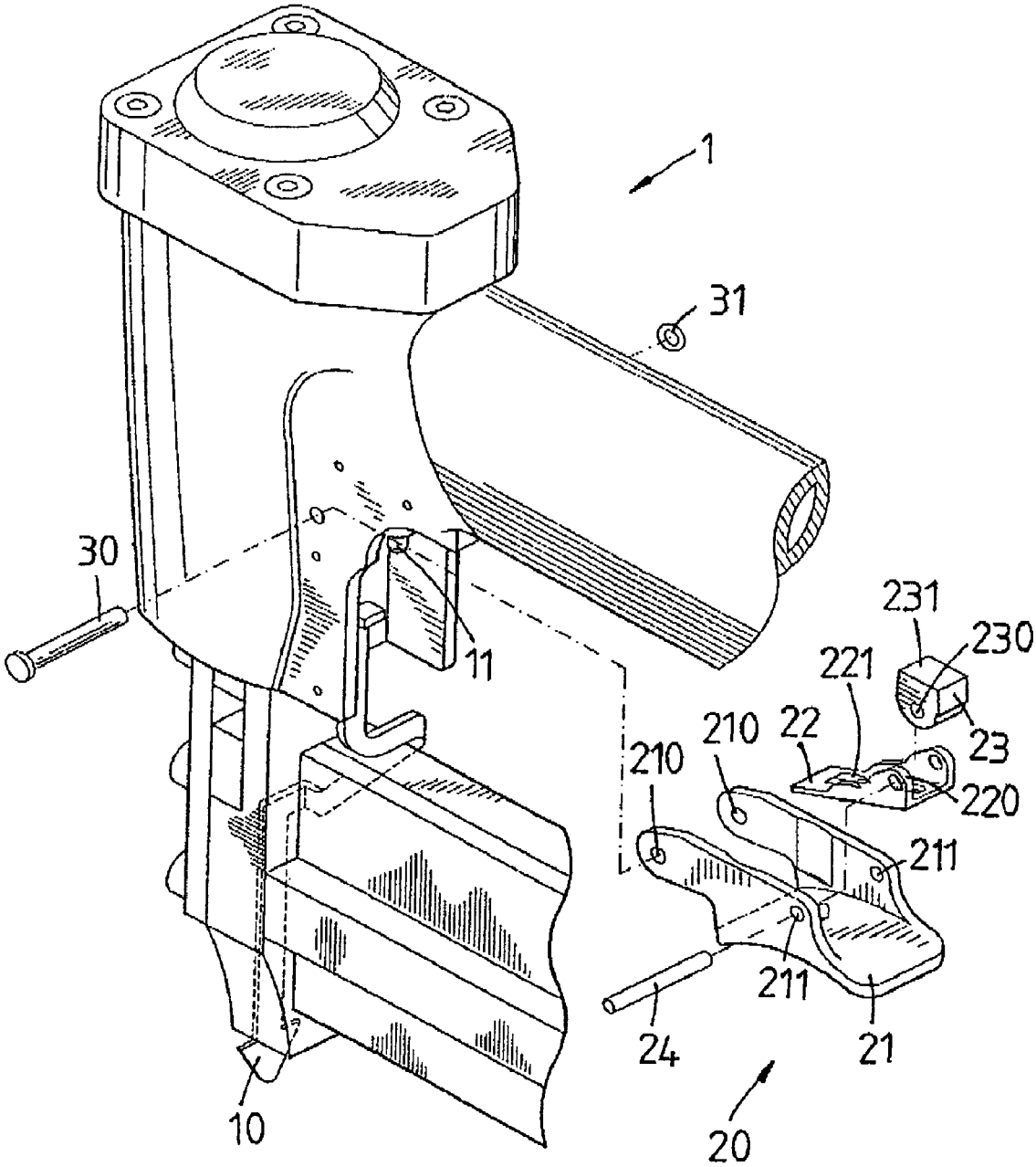
FIG. 5 is an exploded schematic view of the triggering switching device of the nail drive of the present invention.
Figure 6:
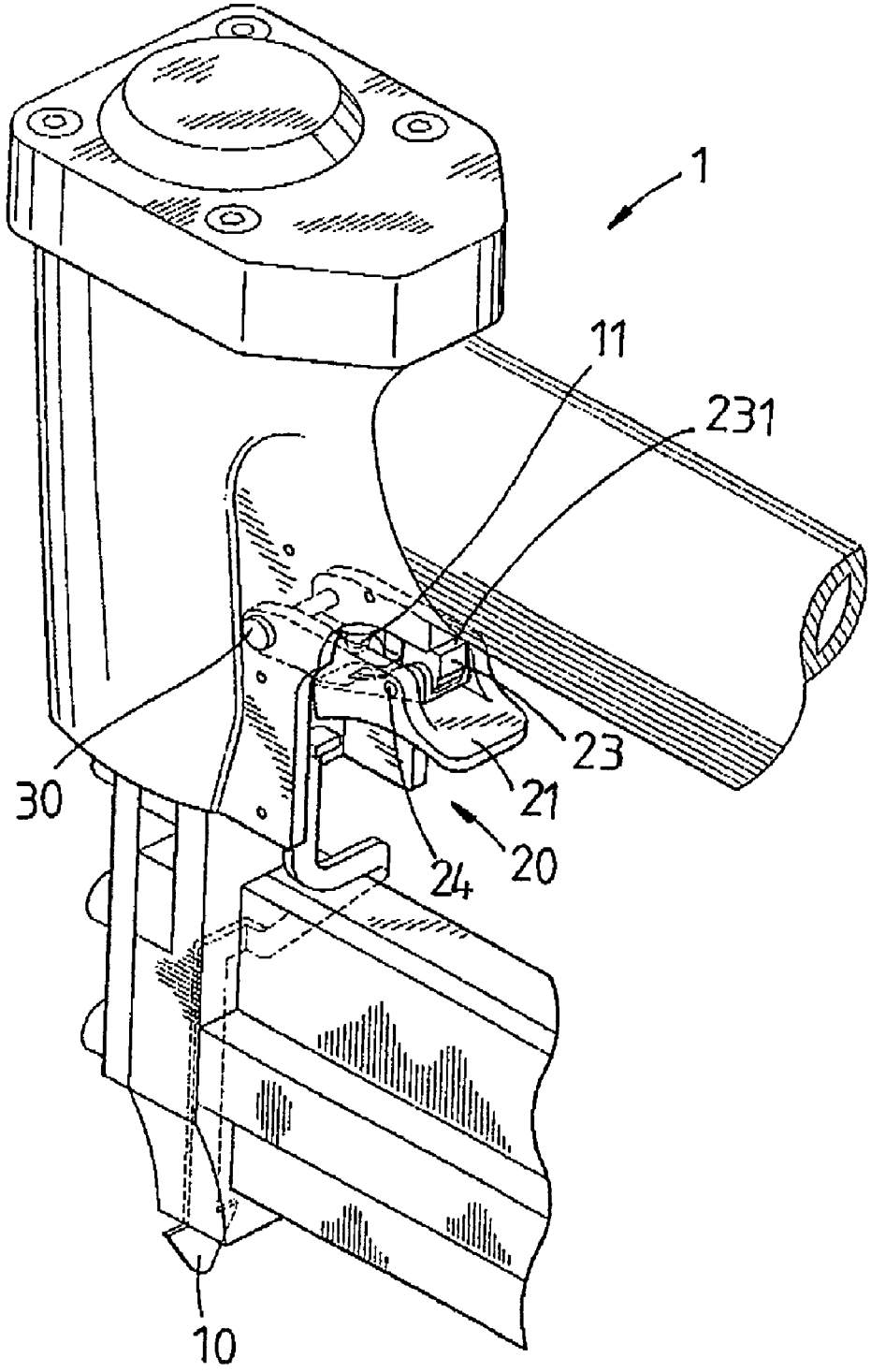
FIG. 6 is a perspective view of the triggering switching device of the nail drive of the present invention.

Referring to FIGS. 5 and 6, the present invention has the following elements.

A nail driver body 1 is included.

A trigger 20 is pivotally installed to the nail driver body 1.

A safety switch 10 is installed in the nail driver body 1. A front end of the safety switch 10 is a nail outlet and a rear end of the safety switch 10 is at a predetermined position of the trigger 20. When the front end of the safety switch 10 is pressed, the rear end of the safety switch 10 is pushed outwards.

A trigger switch 11 is installed in the nail driver body 1. The trigger switch 11 is installed behind the trigger 20. When the trigger switch 11 is touched with a slight force, the trigger 20 will be triggered continuously. If the trigger switch 11 is pressed completely, only one nail is outputted. Above mentioned are known in the prior art and thus the detail will not be further described herein.

The trigger 20 comprises the following elements.

A press plate 21 is a U shape cover. An upper end of the press plate 21 has a pivotal hole 210. By using a pivotal unit 30 to pass through the pivotal hole 210 and then to enter into a pivotal stop unit 31, the trigger 20 is pivotally installed to the nail driver body 1. A middle section of the trigger 20 has through holes 211.

A trigger sheet 22 is included. A lower end of the trigger sheet 22 is installed with a combining end 220. The combining end 220 has an approximate U shape. The trigger sheet 22 is pivotally installed to an inner side of the press plate 21. A middle section of the trigger sheet 22 is installed with a trigger end 221 protruded rearwards for triggering the trigger switch 11.

A buckle block 23 is received in the combining end 220 of the trigger sheet 22. A lateral side of the buckle block 23 is formed with a penetrating hole 230. The buckle block 23 has a buckle end 231 protruded from the other portion of the buckle block 23.

By using a shaft 24 to pass through the through holes 211 of the press plate 12, the holes on the combining end 220 of the trigger sheet 22 and the penetrating hole 230 of the buckle block 23, the trigger sheet 22 and the buckle block 23 are pivotally installed to an inner side of the press plate 21.

With reference to FIG. 6, the assembly of the present invention is illustrated. In assembly, by using a pivotal unit 30 to pass through the pivotal hole 210 and then to enter into a pivotal stop unit 31, and the trigger 20 is pivotally installed to the nail driver body 1. When a front end of the safety switch 10 is pressed, the rear end of the safety switch 10 will touch the trigger sheet 22 of the trigger 20 so that when the trigger 20 is triggered, the trigger end 221 of the trigger sheet 22 will touch the trigger switch 11.

Figure 7:
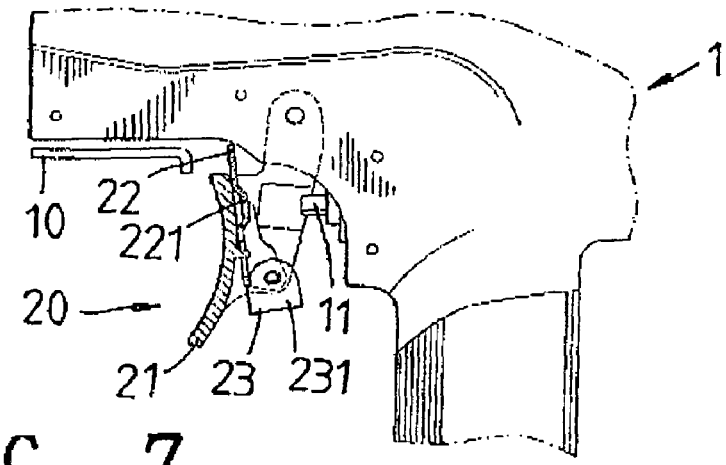
FIGS. 7, 8 and 9 are schematic view showing the operation of the sequential triggering of the triggering switching device according to the present invention.
Figure 8:
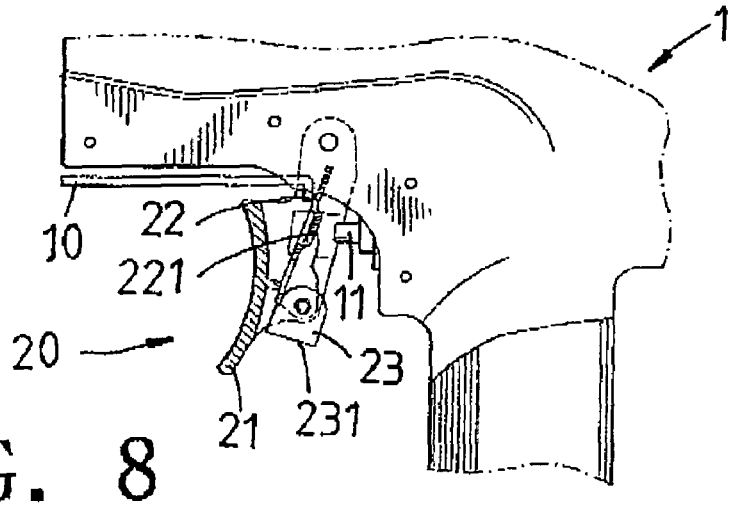
Figure 9:
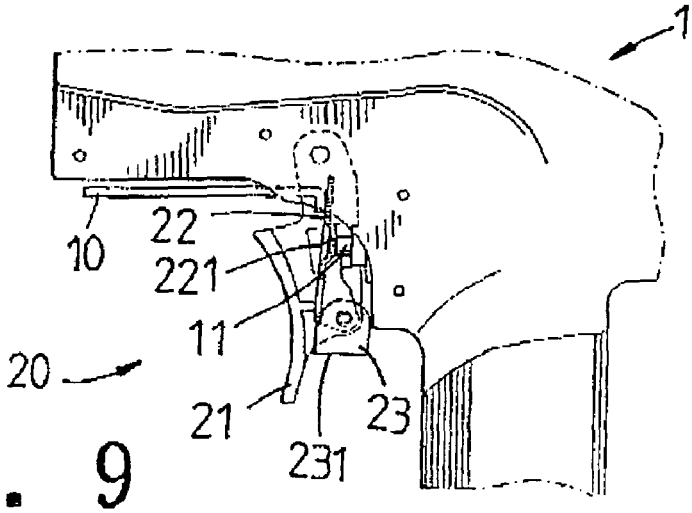
Figure 10:
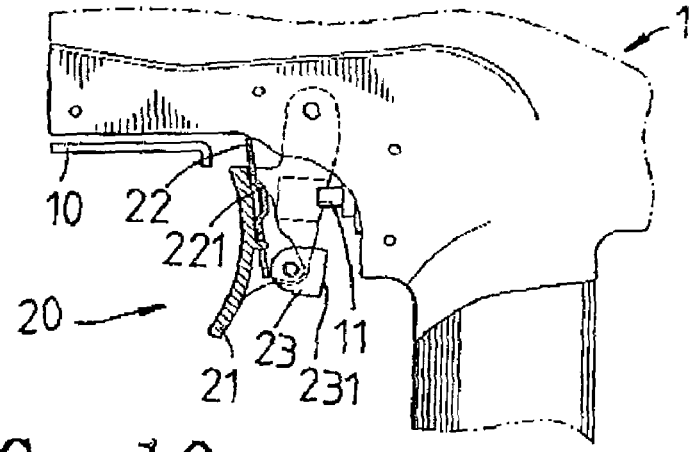
FIGS. 10, 11 and 12 are schematic view showing the operation of the continuous triggering of the triggering switching device according to the present invention.
Figure 11:
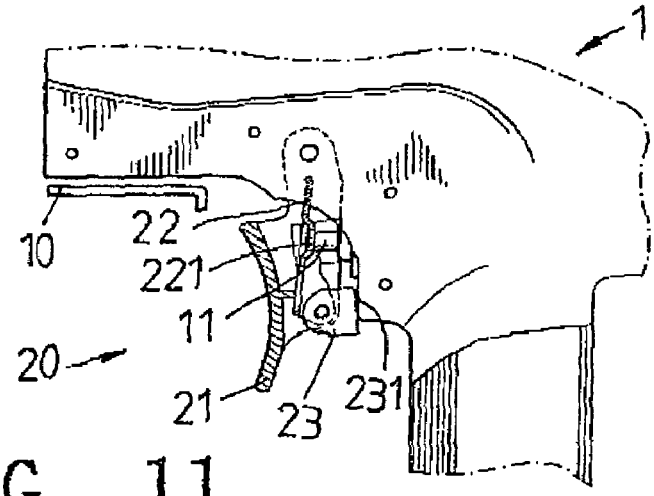
Figure 12:
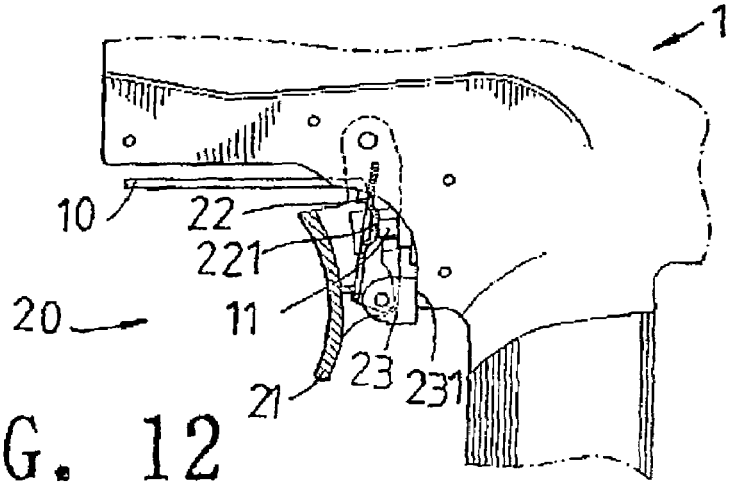

In use of the present invention, as shown in FIGS. 7 to 12, the buckle end 231 of the buckle block 23 of the trigger 20 faces to the lower end of the trigger 20 (see FIG. 7). The nail driver is in sequence trigger state. When the front end of the safety switch 10 of the trigger 20 is pressed, the rear end of the safety switch 10 will touch the trigger sheet 22 so that the trigger sheet 22 moves through a small length toward a rear side of the trigger 20 (see FIG. 8). When the trigger 20 is triggered, since the buckle end 231 of the buckle block 23 faces downwards, the triggering of trigger 20 will not limit by the buckle end 231 so as to move through a longer distance. Then, the trigger sheet 22 of the trigger 20 will be pressed to be at a rear side of the trigger 20. Since the trigger 20 can be pressed to move through a longer distance, the safety switch 10 of the nail driver body 1 is pushed (see FIG. 9). Thereby, the nail driver body 1 is triggered to beat a nail once. This is the process of beating nails sequentially.

Moreover, if the buckle block 23 of the trigger sheet 22 rotates along a reverse direction, the buckle end 231 of the buckle block 23 is vertical to the trigger 20. Then the trigger 20 is pressed firstly (see FIG. 10). Since the buckle block 23 of the trigger 20 is vertical to the trigger 20, the moving length of the trigger 20 is shortened. Thereby, the buckle end 231 of the buckle block 23 will eject the nail driver body 1 (see FIG. 11). Next, the safety switch 10 at a front end of the nail driver body 1 resists against a work piece to enforce the safety switch 10 to displace backwards to eject the trigger sheet 22 to move backwards to touch the trigger switch 11 (referring to FIG. 12). Thereby, the object of beating a nail is achieved. If the trigger 20 is pressed continuously. Only the safety switch 10 is moved to eject the work piece. The object of beating a nail is achieved.

In the present invention, the buckle block 23 is made of metal or plastics.

In summary, in the present invention, a rotatable buckle block 23 pivotally installed on the trigger 20 is adjusted to be horizontal to (pressed with a long distance) or vertical to (pressed with a short distance) the trigger 20 so as to achieve the object of sequential beating a nail or continuously beating a nail.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A triggering switching device of a nail driver, comprising:

a nail driver body;

a trigger in the nail driver body; a rotatable buckle block pivotally installed at one end of the trigger; the buckle block having a buckle end protruded from the buckle block;

a trigger switch at a rear side of the trigger;

wherein when the buckle block is moved so that the buckle end is vertical to the trigger and the moving length of the trigger as the trigger is pressed is shorter than moving length of the trigger as the buckled block is parallel to the trigger, an operation of continuous beating a nail is formed; moreover when the buckle block is moved to be parallel to the trigger, the moving length of the trigger is longer than the moving length of the trigger as the buckled block is vertical to the trigger so as to be in a state of sequential beating a nail.

2. The triggering switching device of a nail driver as claimed in claim 1, wherein the trigger is installed with a safety switch; a trigger sheet is installed in the trigger; when the safety switch is pressed, the safety switch will push the trigger sheet so that the trigger sheet moves rearwards; if the trigger is triggered, the trigger sheet of the trigger will trigger the trigger switch.

3. The triggering switching device of a nail driver as claimed in claim 1, wherein the buckle block is made of metal.

4. The triggering switching device as claimed in claim 1, wherein the buckle block is made of plastics.

5. The triggering switching device of a nail driver as claimed in claim 1, wherein the trigger comprises:

a press plate being a U shape cover; an upper end of the press plate having a pivotal hole; the trigger being pivotally installed to the nail driver body; a middle section of the trigger having through holes;

a trigger sheet; a lower end of the trigger sheet being installed with a combining end; the combining end having an approximate U shape; the trigger sheet being pivotally installed to an inner side of the press plate; a middle section of the trigger sheet being installed with a trigger end protruded rearwards for triggering the trigger switch;

the buckle block received in the combining end of the trigger sheet; a lateral side of the buckle block being formed with a penetrating hole; and a shaft passing through the through holes of the press plate, the holes on the combining end of the trigger sheet and the penetrating hole of the buckle block, the trigger sheet and the buckle block being pivotally installed to an inner side of the press plate.

* * * * *